US005666607A

United States Patent [19]

Camis

[11] Patent Number: 5,666,607

[45] Date of Patent: Sep. 9, 1997

[54] WET CONTACT CHARGING FOR ELECTROPHOTOGRAPHY

[75] Inventor: Thomas Camis, Boise, Id.

[73] Assignee: Hewlett-Packard Company, Palo Alto, Calif.

[21] Appl. No.: 587,351

[22] Filed: Jan. 11, 1996

[51] Int. Cl.[6] ..... G03G 15/02

[52] U.S. Cl. ..... 399/176; 361/226; 399/159; 430/902

[58] Field of Search ..... 355/219, 211, 355/256; 361/225–228; 430/66, 67, 902

[56] References Cited

U.S. PATENT DOCUMENTS

| | | | |
|---|---|---|---|
| 3,835,355 | 9/1974 | Tsukada | 361/225 X |
| 5,089,851 | 2/1992 | Tanaka et al. | 355/219 |
| 5,457,523 | 10/1995 | Facci et al. | 355/219 |
| 5,554,469 | 9/1996 | Larson et al. | 430/902 X |
| 5,557,377 | 9/1996 | Loewen et al. | 355/256 |

FOREIGN PATENT DOCUMENTS

| | | | |
|---|---|---|---|
| 0272072 | 12/1987 | European Pat. Off. | G03G 15/02 |
| 4-109262 | 4/1992 | Japan . | |

*Primary Examiner*—Arthur T. Grimley
*Assistant Examiner*—Sophia S. Chen

[57] ABSTRACT

Embodiments of a wet contact charging method and apparatus for electrophotography charging stations are shown and described. Each embodiment includes placing a charging member, having a charge bias, against an electrophotography charge-receiving member, and placing a liquid between the charging member and charge-receiving member. Preferably, a charging roller is rotated through a liquid-filled container and the wet roller carries liquid into the nip between the roller and a photoconductor. This wet contact charging results in stable, uniform charging without photoconductor release property degradation.

14 Claims, 5 Drawing Sheets

WET CONTACT CHARGING FOR ELECTROPHOTOGRAPHY

FIELD OF THE INVENTION

This invention relates, generally, to contact charging/erasing in electrophotography (EP). More specifically, this invention relates to roller charging with a liquid disposed in the nip between the roller and the photoconductor.

BACKGROUND OF THE INVENTION

In the field of electrophotographic printing, contact charging/erasing of the photoreceptor, herein called the "photoconductor", "organic photoreceptor" ("OPR"), or "organic photoconductor" ("OPC") has several advantages compared to charging with a corona discharge device. Contact charging, such as with a roller, results in effective and uniform erase and charging of the photoconductor surface. Roller charging features high charge efficiency with relatively low power supply requirements and features compatibility with a high speed EP process. A roller charging system also features a small footprint and can be designed to operate reliably and with minimal print faults and defects.

A roller charging system has the health and environmental advantage of producing a low amount of ozone compared to a corona discharge device. However, the ozone concentration at the photoconductor surface during roller charging is higher than during corona charging. This relatively high ozone concentration in and around the nip between the roller and the photoconductor can cause degradation of the photoconductor, especially of the photoconductor release layer. Such release property degradation, and especially the cumulative effect of such degradation over thousands of print cycles, can result in poor release of the developed image from the photoconductor surface to the paper or other print media, and poor release of the residual toner during a subsequent photoconductor cleaning step.

A charging roller or other charging member may comprise a variety of roller designs, such as the conventional rollers known well in the art. Many conventional rollers are conductive elastic rollers having a single layer of electroconductive rubber fixed on a metal core. This rubber layer typically has conductive particles dispersed throughout to give it an appropriate volume resistivity. Alternative rollers include multiple-layer designs, such as those disclosed in Tanaka, et al. (U.S. Pat. No. 5,089,851). The multiple layers of Tanaka include an inner elastic layer, a middle electroconductive layer, and an outer resistive layer.

Supply of a voltage to the roller or other contact charging member can be done in various ways, which are well-known in the art. The voltage may result from a DC source, an AC source, or a DC and AC source. Nakamura et al (European Patent Application 0272072) discloses charging by forming a vibratory field between the charging member and the charge-receiving member, which may be accomplished by superimposing a DC voltage and an AC voltage.

SUMMARY OF THE INVENTION

The general object of the present invention is to provide a system that uniformly and stably charges an electrophotography photoconductor, while minimizing or eliminating ozone production and degradation of the photoconductor surface release properties. Another object of the invention is to provide a system which minimizes or eliminates toner offset and ghosting. Thus, another general object of the invention is to improve photoconductor life and minimize print faults and defects in a high speed EP process.

The present invention comprises the method and apparatus for liquid immersion or "wet" contact charging of a photoconductive surface. The method comprises providing a liquid interface between a charging apparatus and the photoconductor surface, through which liquid the charge transport is effective and non-ozone producing.

One embodiment of the method and apparatus comprises immersing part of the charging roller or other member in a bath of process-compatible liquid, herein also called the "charging liquid", so that the roller rotates to carry liquid into the gap or "nip" between the roller and the photoconductor. A voltage is applied across the roller-photoconductor nip, as in conventional EP roller charging systems. Charge transport occurs through the liquid across the nip in an improved fashion compared to conventional contact systems. Any charging liquid that adheres to the photoconductor is then preferably removed from the photoconductor down-stream of the charging step by a wiping blade or other liquid management device. The charging liquid is preferably selected for its appropriateness based on such properties as resistivity, charge transport properties and physical and chemical property compatibility with the process.

DETAILED DESCRIPTION OF THE PREFERRED EMBODIMENT

Figure 1:
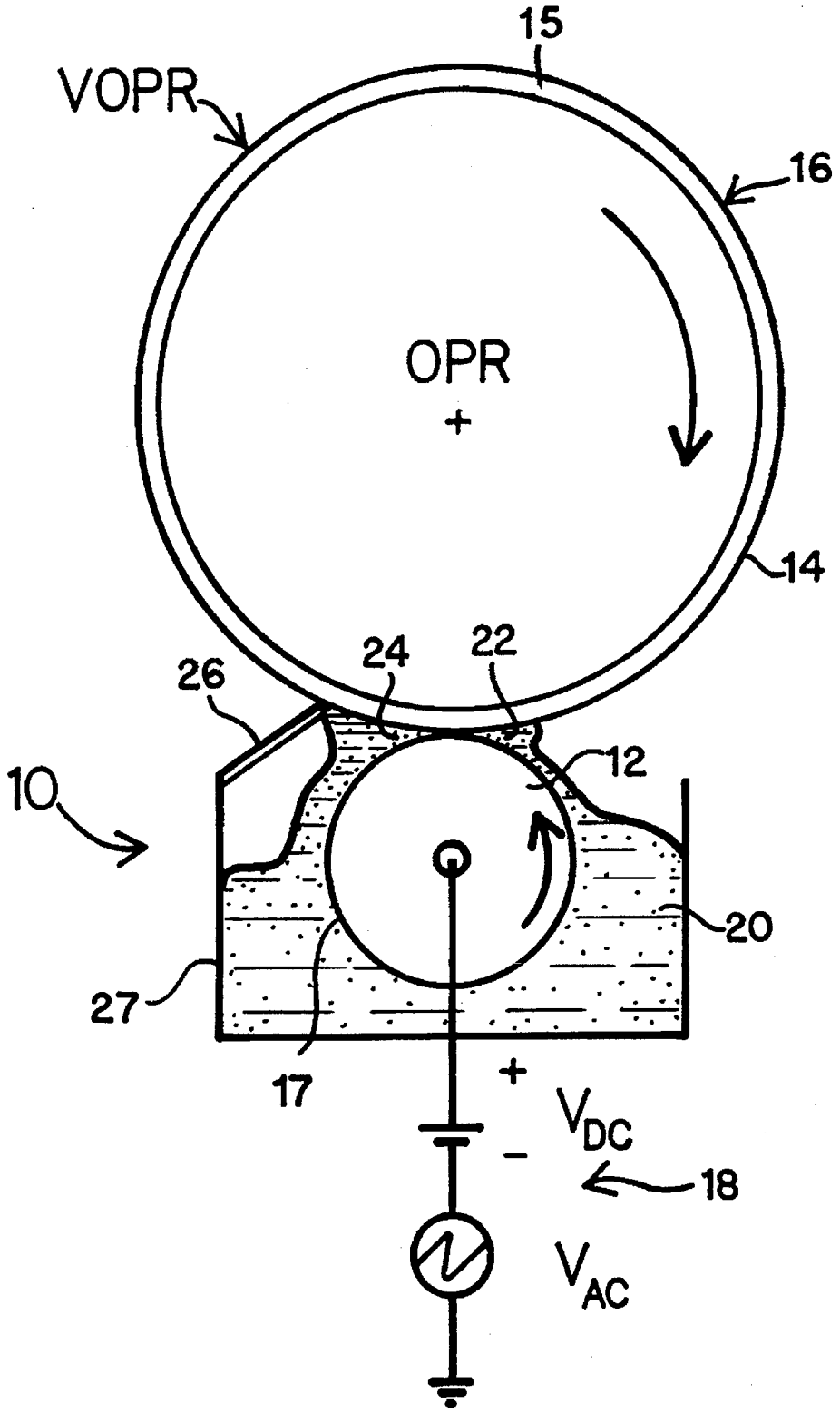
FIG. 1 is a schematic illustration of one embodiment of the invention, showing a photoconductor drum being wet-contact-charged by a charging roller.

Referring to the Figures, there is illustrated one, but not the only, embodiment of the invented wet contact charging ("WCC") method and apparatus (10). In the embodiment of FIG. 1, charging roller (12) deposits a positive charge to the surface (14) of the photoconductor (16) through the liquid interfacial charge transport layer between the photoconductor and the roller surface (17). Voltage source (18) preferably supplies both a DC and an AC bias, but, alternatively, may supply one or the other.

The roller (12) is disposed in a bath of liquid (20) to an extent which allows the roller to pick up and carry a coating of liquid toward the photoconductor (16). As the roller rotates to place the wet roller surface (17) adjacent to the photoconductor, liquid fills the nip (22) to form a liquid interface between the roller (12) and the photoconductor (16). Liquid (20) preferably fills the entire nip (22) and is carried through the nip (22) to the second side (24) of the nip (22) with rotation of the roller (12). Near the second side (24) is preferably an elastomeric blade (26) or other liquid removal device, which scrapes the charging liquid (20) off of the photoconductor surface (14) before the photoconductor

(16) rotates to the exposure step of the EP process. The blade (26) may be positioned relative to the liquid container (27) in such a way that the charging liquid (20) falls back into the container (27) for reuse.

The preferred charging liquid (20) is a normal paraffin liquid such as Norpar™. The resistivity of Norpar™ liquids is on the order of $10^{13}$ ohm-cm. Typical physical properties for two liquids that may be used as the charging liquid (20) are:

| | Flashpoint. °C. | Viscosity, Centipoise at 77° F. |
|---|---|---|
| Norpar 15 ™ | 240 | 3 |
| Norpar 13 ™ | 203 | 2 |

The roller (12) may be a variety of designs, as explained in the Related Art section. A preferred roller is a liquid-cast type polymer, $10^7$–$10^8$ ohm lossy dielectric single-layer roller. Alternatively, other charging members may be used, such as a partially conductive blade. Thus, "charging member" may include any member with a surface to which a charge may be applied for charging of another member.

The photoconductor (16) may also be a variety of designs, for example, a rotating single layer photoconductor drum coated with a vinyl silicone overcoat release layer (15) or a layered design comprised of a release layer, charge transport layer, and charge generation layer. Alternately, a moving photoconductor belt or other charge-receiving means could be used.

Figure 2:
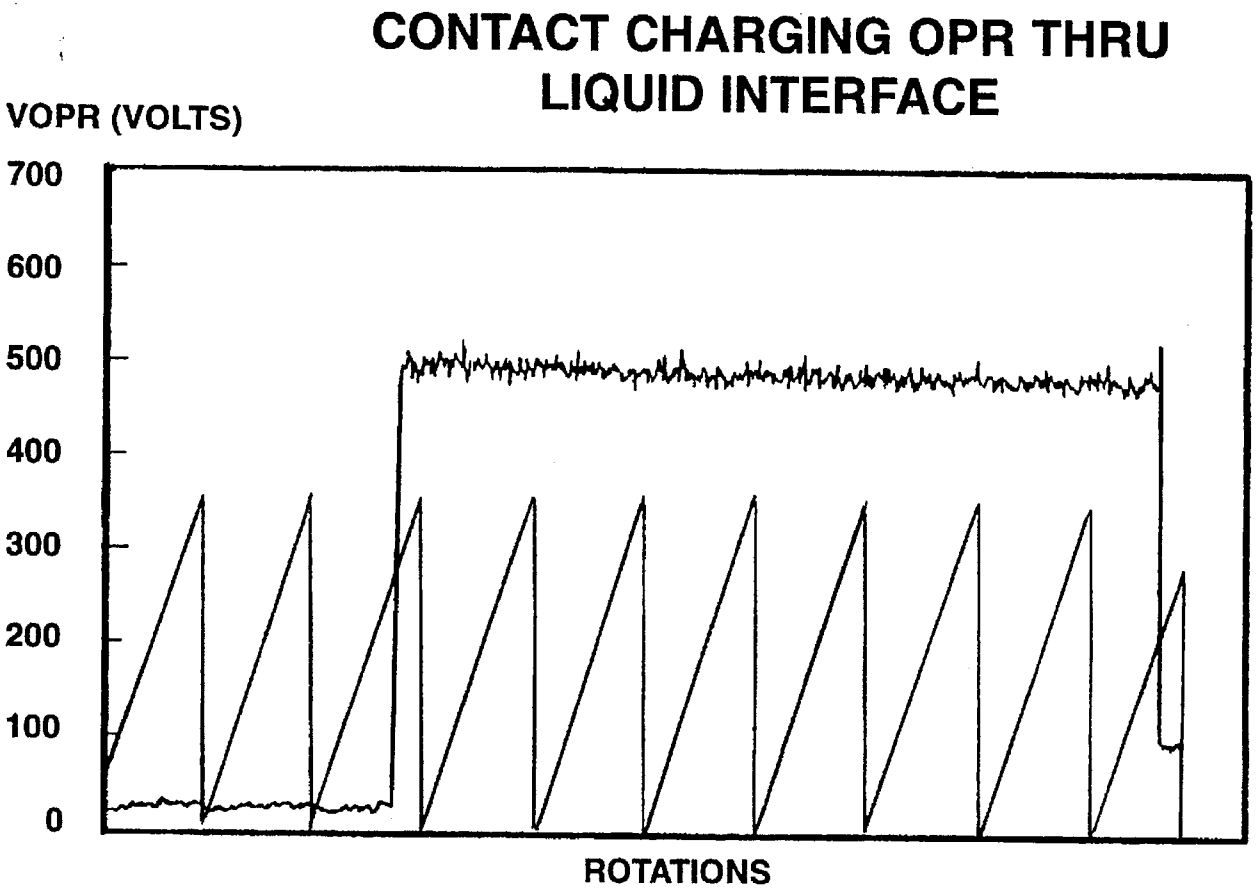
FIG. 2 is a graph showing the photoconductor voltage vs. photoconductor revolutions during a period of wet charging.

In one embodiment of the invented method, a DC-AC voltage is applied to a charging roller (12) to the photoconductor (16), an organic photoreceptor ("OPR"). A DC voltage of approximately +850 volts and an AC voltage of approximately 2.0 Kv at 600 Hz are applied to the roller (12). The roller (12) is approximately half-immersed in a container (27) of Norpar™ and carries Norpar™ through the nip (22) as it rotates at a ratio of approximately 1:1 roller speed:OPR speed. The nip (22) is typically approximately 1 micron or less, and depends, for example, on the roller (12) and OPR (16) dimensions, the mechanical forces on the roller and OPR, and the viscosity of the charging liquid. Charge transport takes place through the charging liquid (20), resulting in a high, flat, and stable charge on the OPR (16), shown in FIG. 2. The saw-tooth pattern and the X-axis of FIG. 2 represent rotations of the OPR (16). During the third rotation, the voltage source (18) is turned on and the OPR voltage ("VOPR") goes up to about 500 volts and stays there with little variation or noise. The OPR voltage stays flat and stable until the end of the test.

Figure 3:
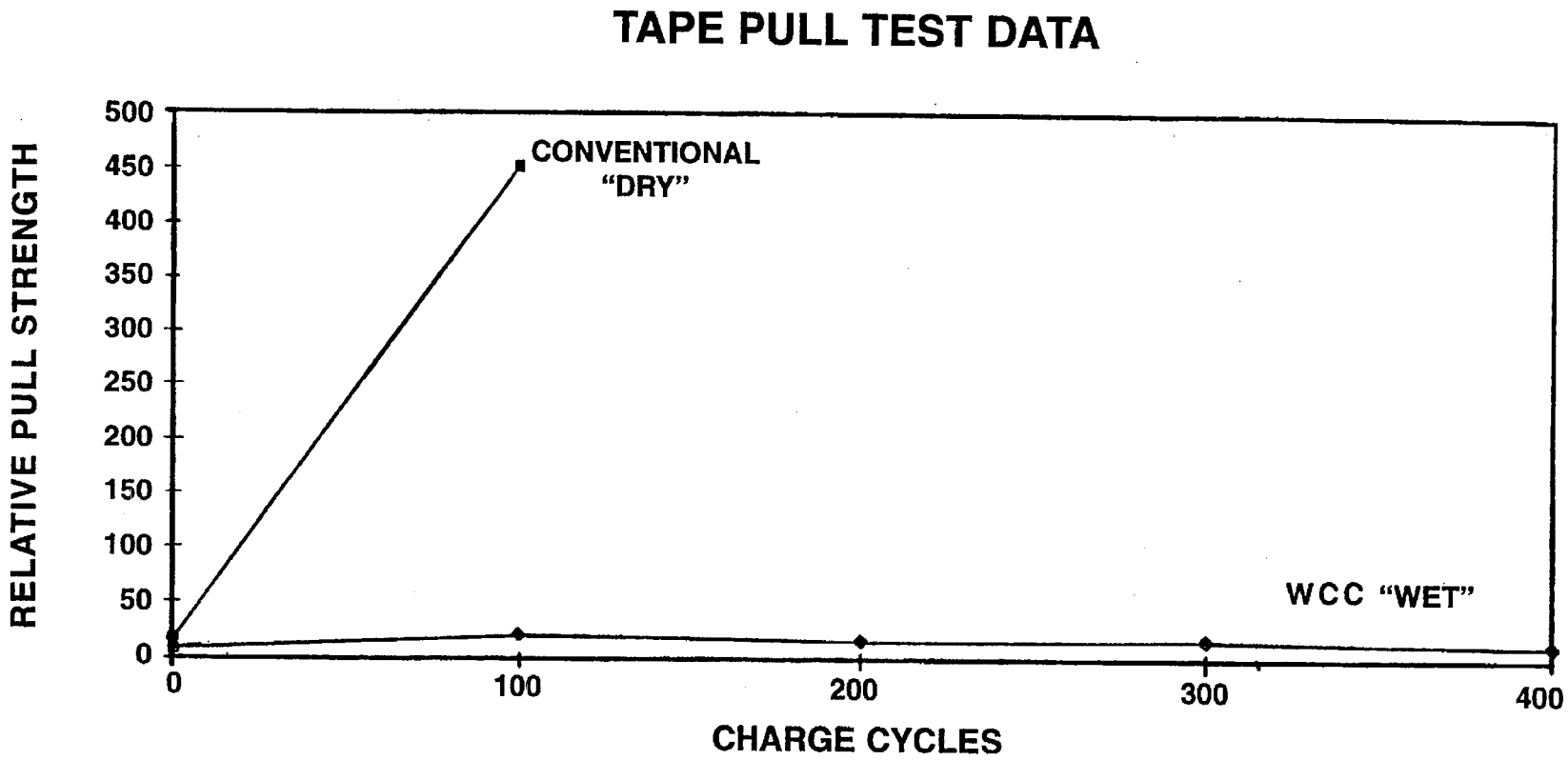
FIG. 3 is a graph showing the results of a Tape Pull Test, illustrating the relative release properties of photoconductors that have been charged over multiple cycles with a conventional dry roller system and a wet contact charge system.

FIG. 3 shows the results of a tape pull test comparing conventional dry charging and wet contact charging, and indicates an improvement in release property stability with wet contact charging. The tape pull testing in FIG. 3 was performed with an INSTRON™ pull force device. The testing recorded the relative pull strength required to remove a tape strip from the surface of 2 OPRs: 1) an OPR charged over multiple cycles as in the above WCC method and 2) an OPR that has been charged over multiple cycles by conventional dry contact roller charging. The relative pull strength required for removing the tape from the conventionally-charged OPR goes from <25 for a new OPR to 450 after 100 charging cycles. On the other hand, the relative pull strength for the wet-contact-charged OPR starts at <25 when new and stays at <25 for the entire test of 400 cycles. These results show that the conventional dry charging causing instability in the release properties of the OPR, which is believed to be the result of oxidation of the release layer by repeated exposure to high concentrations of ozone in the nip. On the other hand, the WCC does not degrade the release properties of the release layer, so that the release properties are stable over many cycles.

The presence of charge liquid in the nip is believed to alter the air ionization that is involved in charge transport but that also typically oxidizes and degrades the release layer. The liquid is believed to reduce, eliminate, or neutralize ozone production. The liquid is believed to moderate or prevent photoconductor surface oxidation, while allowing or even enhancing charge transport.

The preferred roller (12) carries the charging liquid (20) into the nip (22) by virtue of the wet roller surface (17) rotating to contact or be adjacent to the photoconductor surface. In other embodiments, with other charging members besides a roller, the charging liquid may be carried, injected or otherwise fed into the nip by other means, as long as the charging member is wetted and, preferably, as long as liquid fills the nip between the charging member and the photoconductor.

Figure 4:
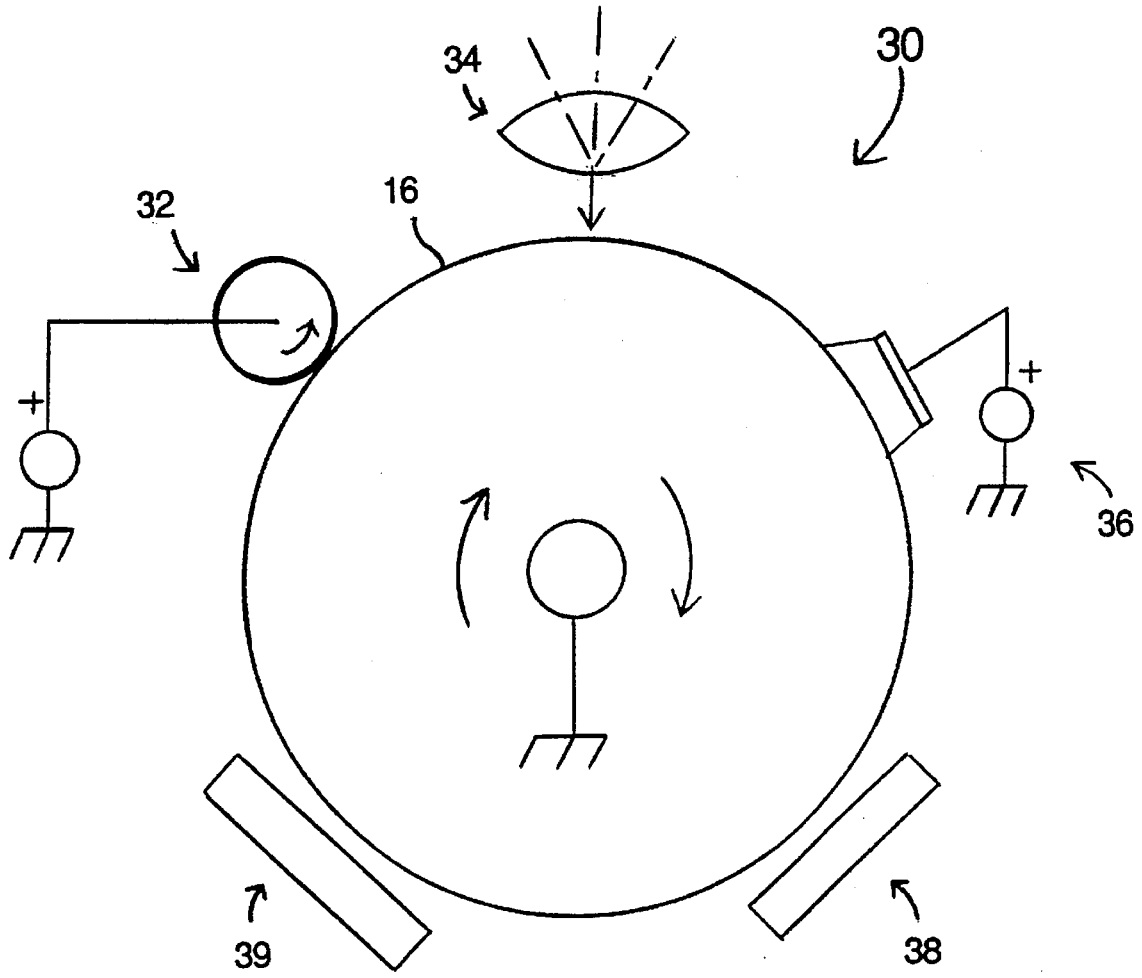
FIG. 4 is a simplified schematic illustration of a generalized electrophotographic print engine.

Applications for the invented WCC apparatus and method include use as an electrophotography charging station (32), such as shown in the general and schematic electrophotography system (30) of FIG. 4. FIG. 4 illustrates the photoconductor 16 and the typical sequence of electrophotography stations, including the charging station (32), exposure station (34), development station (36), image transfer station (38), and cleaning station (39). In this description and the claims, "charging" means providing a generally uniform electric field across the photoconductor and depositing a generally uniform charge layer on a photoconductor. "Exposure" means causing light to strike the photoconductor in a pattern, wherein the charges of illuminated photoconductor regions are neutralized by increased conductivity across the photoconductor and the charges of unilluminated photoconductor regions are retained, thus forming a latent electrostatic image. "Development" refers to producing a physical image of electrostatically-held toner pigment on the photoconductor, typically, by bringing a charged development member close to the latent electrostatic image in the presence of toner, and causing toner to migrate to form the physical image. "Image transfer" involves bringing paper or other media into physical contact with the developed photoconductor surface and applying a charge to the paper to attract the toner onto the paper. After image transfer, the photoconductor moves to the cleaning step, which involves removing residual toner from the photoconductor, to prevent toner from being present in the erasing/charging steps.

In addition to the steps/stations shown in FIG. 4, others may be included in the EP process. For example, after the image transfer step, the paper typically proceeds to the fixing step, in which toner is fused to the paper, typically by fusing of a resin-component or other binder of the toner to the paper.

Figure 5:
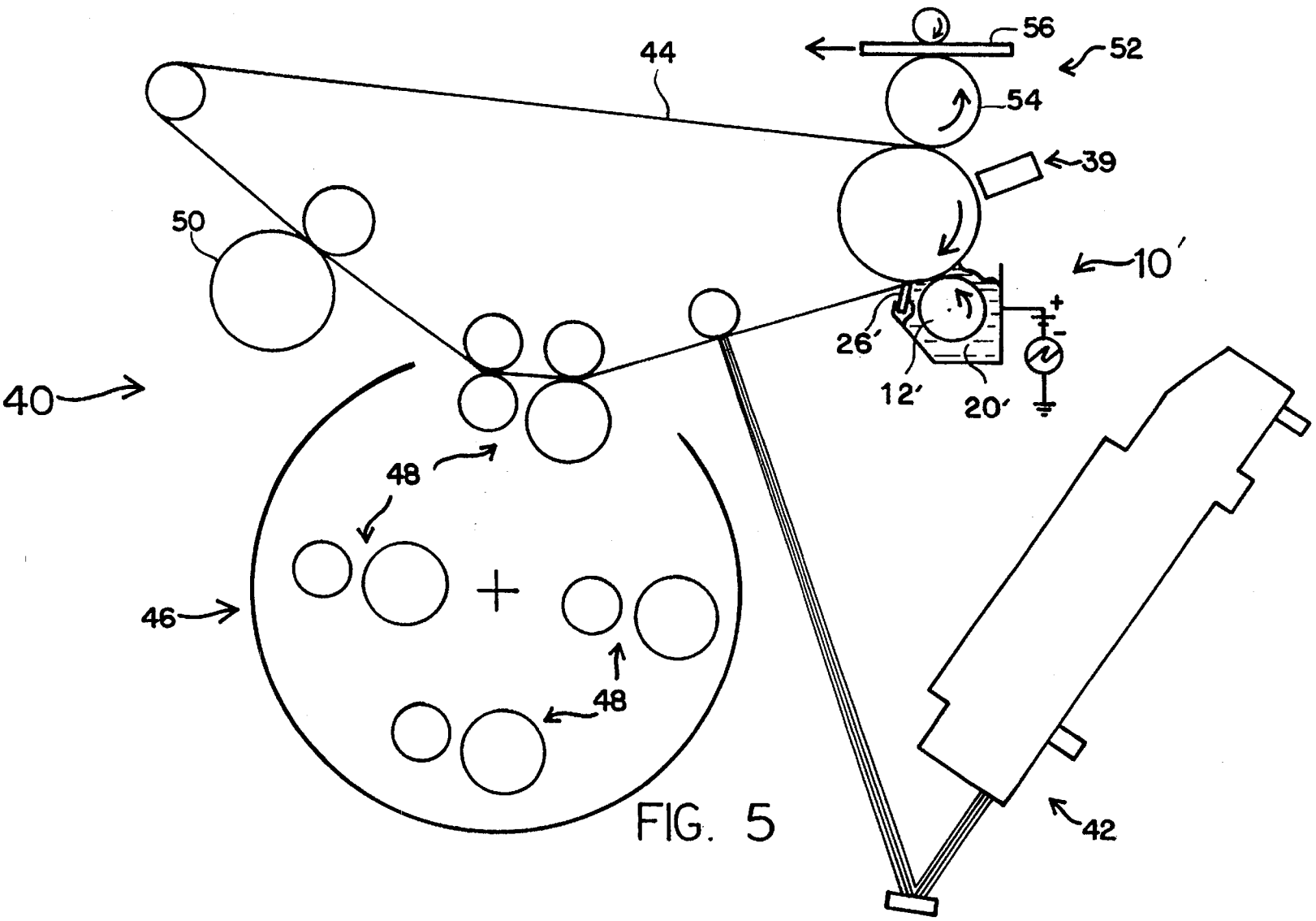
FIG. 5 is a simplified schematic illustration of one embodiment of a color liquid EP system using wet-contact charging.

The invented WCC apparatus and method is preferably used in liquid-toner electrophotography, commonly called "liquid EP", but may be used for any application requiring charging of a moving member or charging of a surface by a roller or other moving charging member. A process scheme for color liquid EP including a WCC apparatus is shown schematically in FIG. 5. The color process system (40) preferably includes a WCC roller charging device (10') as the charging station, a laser exposure unit (42), a belt photoconductor (44), a development carousel (46) containing four developers (48) (black, cyan, yellow, and magenta), a film forming roller (FFR) (50) for removing excess liquid, and image transfer station (52). Charging device (10') includes wet roller (12'), charging liquid (20'), and liquid removal blade (26'). In this four-pass color EP system (40), the image from each pass is transported to the heated intermediate transport member (ITU) (54), where it is retained until all color planes are present. The color toners and resulting image are then transferred to paper (56) or other media.

Although this invention has been described above with reference to particular means, materials and embodiments, it is to be understood that the invention is not limited to these disclosed particulars, but extends instead to all equivalents within the scope of the following claims.

What is claimed is:

1. An electrophotographic method for charging a photoconductor comprising:

wetting a charging member by moving the charging member through a container of liquid;

applying a charge to the charging member; and placing the wet charging member against a photoconductor so that the liquid fills a nip between the charging member and the photoconductor.

2. A method as in claim 1, further comprising removing the liquid from the photoconductor after the wet charging member is placed against the photoconductor.

3. A method as in claim 1 wherein placing the wet charging member against a photoconductor comprises rotating a wet surface of a charging roller against the photoconductor.

4. An electrophotographic charging system for charging a photoconductor, the charging system comprising:

a charging member having a surface for placement near the photoconductor;

a voltage supply means for applying a charge bias to the charging member;

a container for receiving a liquid and the charging member, so that the charging member surface contacts the liquid: and means for moving the charging member surface through the container of liquid and near the photoconductor, so that liquid is disposed between the charging member and the photoconductor.

5. A charging system as set forth in claim 4, wherein the charging member comprises a rotatable charging roller, and said means for moving the charging member surface comprises means for rotating the roller surface through the container of liquid and against the photoconductor.

6. A charging system as in claim 4, wherein the voltage supply means comprises an AC and a DC source.

7. An electrophotographic charging system for improving photoconductor release property stability, the charging system comprising:

a photoconductor comprising a release layer;

a charging member having a surface near said release layer;

a liquid disposed between the charging member surface and said release layer; and a voltage supply means for applying a charge bias to the charging member.

8. A charging system as set forth in claim 7, wherein said liquid has a resistivity on the order of $10^{13}$ ohm-cm.

9. A charging system as set forth in claim 7, wherein the charging member surface contacts the release layer and the liquid fills a nip between the charging member surface and the release layer.

10. A method of improving release property stability of a photoconductor release layer comprising charging a photoconductor having an outer release layer with a wet charging member.

11. A method as set forth in claim 10, wherein charging the photoconductor comprises depositing a uniform charge layer on the photoconductor.

12. A method as set forth in claim 10, further comprising exposure of the photoconductor, and wherein the step of charging the photoconductor takes place prior to the step of exposure.

13. A method as set forth in claim 10, further comprising wetting the charging member with a normal paraffin liquid.

14. A method as set forth in claim 10, further comprising wetting the charging member with a liquid having a resistivity on the order of $10^{13}$ ohm-cm.

* * * * *